US007314027B2

(12) United States Patent
Murata

(10) Patent No.: US 7,314,027 B2
(45) Date of Patent: Jan. 1, 2008

(54) VARIABLE VALVE UNIT FOR INTERNAL COMBUSTION ENGINE

(75) Inventor: Shinichi Murata, Okazaki (JP)

(73) Assignees: Mitsubishi Fuso Truck and Bus Corporation, Tokyo (JP); Mitsubishi Jidosha Kogyo Kabushiki Kaisha, Tokyo (JP)

( * ) Notice: Subject to any disclaimer, the term of this patent is extended or adjusted under 35 U.S.C. 154(b) by 135 days.

(21) Appl. No.: 11/103,556

(22) Filed: Apr. 12, 2005

(65) Prior Publication Data

US 2005/0274340 A1 Dec. 15, 2005

(30) Foreign Application Priority Data

Apr. 13, 2004 (JP) ..... 2004-117812

(51) Int. Cl.
*F01L 1/34* (2006.01)

(52) U.S. Cl. ..... 123/90.16; 123/90.39; 123/90.6

(58) Field of Classification Search ..... 123/90.16, 123/90.2, 90.39, 90.41, 90.44, 90.6
See application file for complete search history.

(56) References Cited

U.S. PATENT DOCUMENTS 5,121,716 A * 6/1992 Takahashi et al. ..... 123/531
5,186,128 A * 2/1993 Murata et al. ..... 123/90.16

FOREIGN PATENT DOCUMENTS

JP 3245492 B2 10/2001

* cited by examiner

*Primary Examiner*—Ching Chang
(74) *Attorney, Agent, or Firm*—Birch, Stewart, Kolasch & Birch, LLP

(57) ABSTRACT

A variable valve unit for an internal combustion engine includes a first arm opening and closing a valve, a second arm driven by a cam, a third arm receiving a displacement of the second arm to drive the first arm, and a variable mechanism displacing the fulcrum of the second arm. The second arm has a drive plane. The third arm has a shaft member formed with a driven surface contacting with the drive plane. The displacement of the second arm is transmitted to the third arm with sliding between the driven surface and the drive plane.

20 Claims, 14 Drawing Sheets

VARIABLE VALVE UNIT FOR INTERNAL COMBUSTION ENGINE

CROSS-REFERENCE TO RELATED APPLICATIONS

This application is based upon and claims the benefit of priority from prior Japanese Patent Applications No. 2004-117812, filed Apr. 13, 2004, the entire contents of which are incorporated herein by reference.

BACKGROUND OF THE INVENTION

1. Field of the Invention

The present invention relates to a variable valve unit for an internal combustion engine, which can vary a drive phase of an intake or exhaust value.

2. Description of the Related Art

Most engines built for automobiles are equipped with a variable valve unit to restrict exhaust gas of an engine and to reduce fuel consumption (gas mileage). The variable valve unit changes a phase, that is, open and close timing of intake/exhaust valve in accordance with driving mode of automobiles.

A reciprocating cam structure is given as the structure of the variable valve unit. According to the reciprocating cam structure, a phase of cam formed in a camshaft is temporarily replaced with a reciprocating cam. The reciprocating cam has a base circle interval and a lift interval, which communicate with each other.

In this kind of reciprocating cam structure, a rocker arm mechanism is often used to vary a ratio of a base circle interval and a lift interval replaced with the reciprocating cam. The rocker arm mechanism changes the foregoing ratio in accordance with driving mode of automobiles. For example, Japanese Patent No. 3245492 discloses the variable valve unit described above.

In the variable valve unit disclosed in the foregoing Japanese Patent No. 3245492, components of the variable valve unit are attached to a cylinder head in order.

When assembling these components of the variable valve unit into the cylinder head, there is a possibility that an assembly error occurs. The assembly error is a factor of generating a difference in each valve lift and valve opening timing. If the difference occurs in valve lift and valve opening timing, a difference occurs in combustion state of each cylinder. The difference of combustion state of each cylinder is a factor of generating vibration and worsening gas mileage (fuel consumption).

The variable valve unit disclosed in the foregoing Japanese Patent No. 3245492 is hard to adjust the assembly error in the variable valve unit.

BRIEF SUMMARY OF THE INVENTION

An aspect of the present invention is to provide a variable valve unit for an internal combustion engine, which can adjust an assembly error of each component with a relatively simple structure.

According to the present invention, a variable valve unit for an internal combustion engine includes camshaft, power transmission member and adjustment mechanism.

The camshaft is rotatably provided in an internal combustion engine. The internal combustion engine includes an intake valve and an exhaust valve.

The power transmission member opens and closes at least one of the intake valve and the exhaust valve. The camshaft drives the power transmission member.

The adjustment mechanism can adjust a drive position of the camshaft with respect to the power transmission member in a non-actuation of the internal combustion engine. The adjustment mechanism is provided at a place which does not link with a rotation of the camshaft.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A variable valve unit according to a first embodiment of the present invention will be described below with reference to FIG. 1 to FIG. 9.

Figure 1:
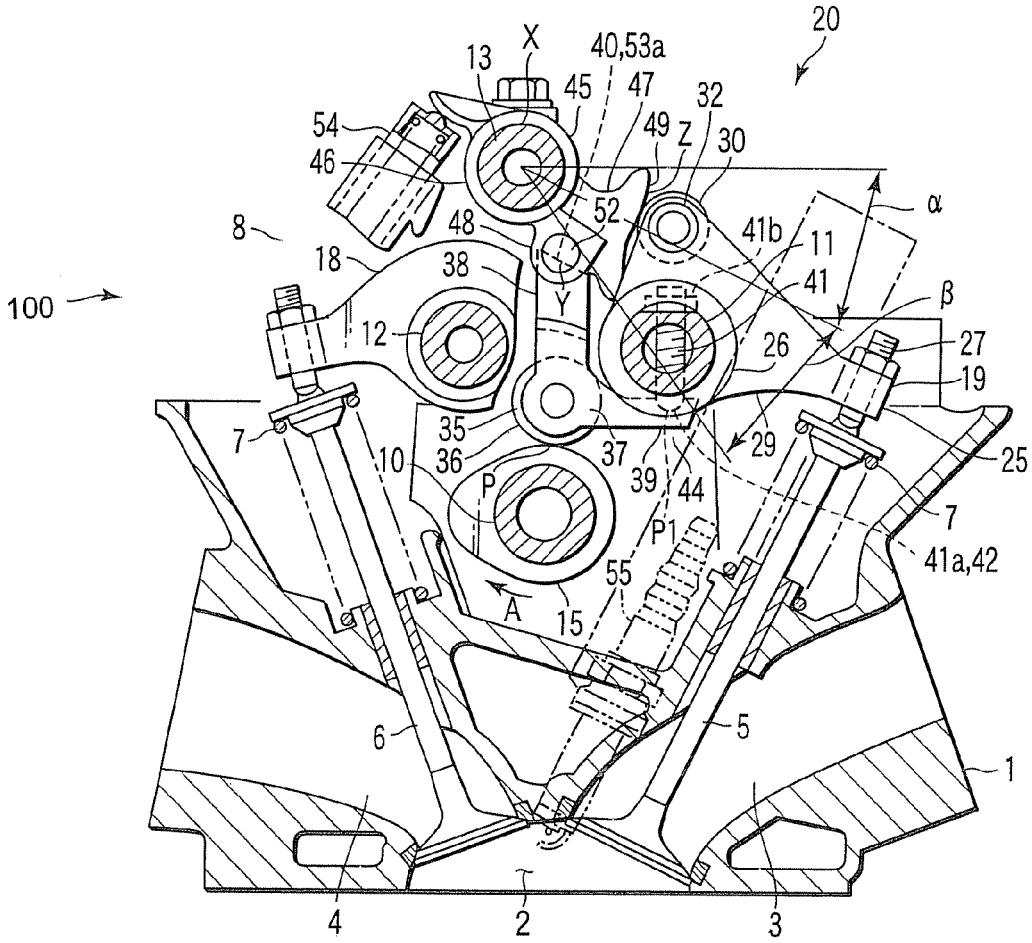
FIG. 1 is a cross-sectional view showing a variable valve unit according to a first embodiment of the present invention together with a cylinder head attached with the same unit.

FIG. 1 is a cross-sectional view showing a cylinder head 1 of a reciprocating gasoline engine 100. The engine 100 includes several cylinders, for example. These cylinders are arranged in series.

As shown in FIG. 1, the cylinder head 1 is formed with a combustion chamber 2 at the lower portion correspondingly to each cylinder. The cylinder head 1 is provided with a pair of intake ports 3 and exhaust ports 4 for each combustion chamber 2. In FIG. 1, only one side of the intake port 3 and the exhaust port 4 is shown.

An intake valve 5 is built into the cylinder head 1. The intake valve 5 opens and closes the intake port 3. The intake valve 5 is a reciprocating valve. An exhaust valve 6 is built into the cylinder head 1. The exhaust valve 6 opens and closes the exhaust port 4. The exhaust valve 6 is a reciprocating valve. The foregoing intake and exhaust valves 5 and 6 are a normally close type value urged to the valve-closing direction by a valve spring 7.

The cylinder head 1 is attached with a valve system 8, which drives several intake and exhaust valves 5 and 6, at the upper portion. The valve system 8 is a single overhead camshaft (SOHC) type.

The valve system 8 will be explained below. The valve system 8 includes camshaft 10, intake rocker shaft 11, exhaust rocker shaft 12, support shaft 13, rocker arm 18 and rocker arm mechanism 19.

The camshaft 10 is arranged above the combustion chamber 2. The camshaft 10 extends along the longitudinal direction of the cylinder head 1. The camshaft 10 is rotatable.

The intake rocker shaft 11 is arranged above the camshaft 11 and on one side of the widthwise direction of the cylinder head 1 at the same time. The rocker shaft 11 is approximately parallel with the camshaft 10. The rocker shaft 11 is rotatably supported.

The exhaust rocker shaft 12 is fixed on the side opposite to the intake rocker shaft 11. The rocker shaft 12 is approximately parallel with the camshaft 10.

The support shaft 13 is fixed at the vicinity of the rocker shaft 11. For example, the support shaft 13 is fixed above in between the rocker shafts 11 and 12. The support shaft 13 is approximately parallel with the camshaft 10.

The camshaft 10 is driven by a crank output of the engine 100. Thus, the camshaft 10 rotates to an arrow direction A shown in FIG. 1. The camshaft 10 is formed with one intake cam 15 and two exhaust cams 16 correspondingly to each combustion chamber 2.

Figure 2:
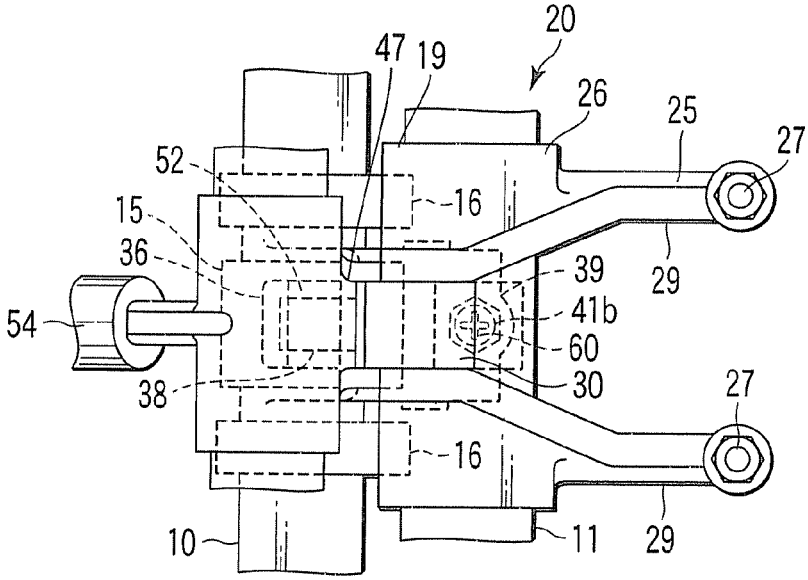
FIG. 2 is a top plan view showing the variable valve unit shown in FIG. 1.

The intake cam 15 is formed at a shaft portion of the camshaft 10. The shaft portion is a portion which faces the center of the combustion chamber 2 in the camshaft 10. As depicted in FIG. 2, the exhaust cam 16 is formed at both sides of the intake cam 15 one by one in the camshaft 10.

As illustrated in FIG. 1, the exhaust rocker shaft 12 is provided with a rocker arm 18 for driving the exhaust valve 6 for each valve 6. The rocker arm 18 is rotatable. In FIG. 1, only one-side rocker arm 18 is shown.

The intake rocker shaft 11 is provided with a rocker arm mechanism 19 for each intake cam 15. The rocker arm mechanism 19 drives the paired intake valves 5 together. The rocker arm mechanism 19 opens and closes the intake valves 5 with the rotation of the camshaft 10. The foregoing rocker arm mechanism 19, camshaft 10 and rocker shaft 11 forms a variable valve unit 20.

The intake valve 5 and the exhaust valve 6 are opened and closed by the rocker arm mechanism 19 and the rocker arm 18 according to a predetermined combustion cycle. The predetermined cycle is four strokes, that is, intake stroke, compression stroke, combustion and expansion stroke, and exhaust stroke, which are sequentially given.

Figure 3:
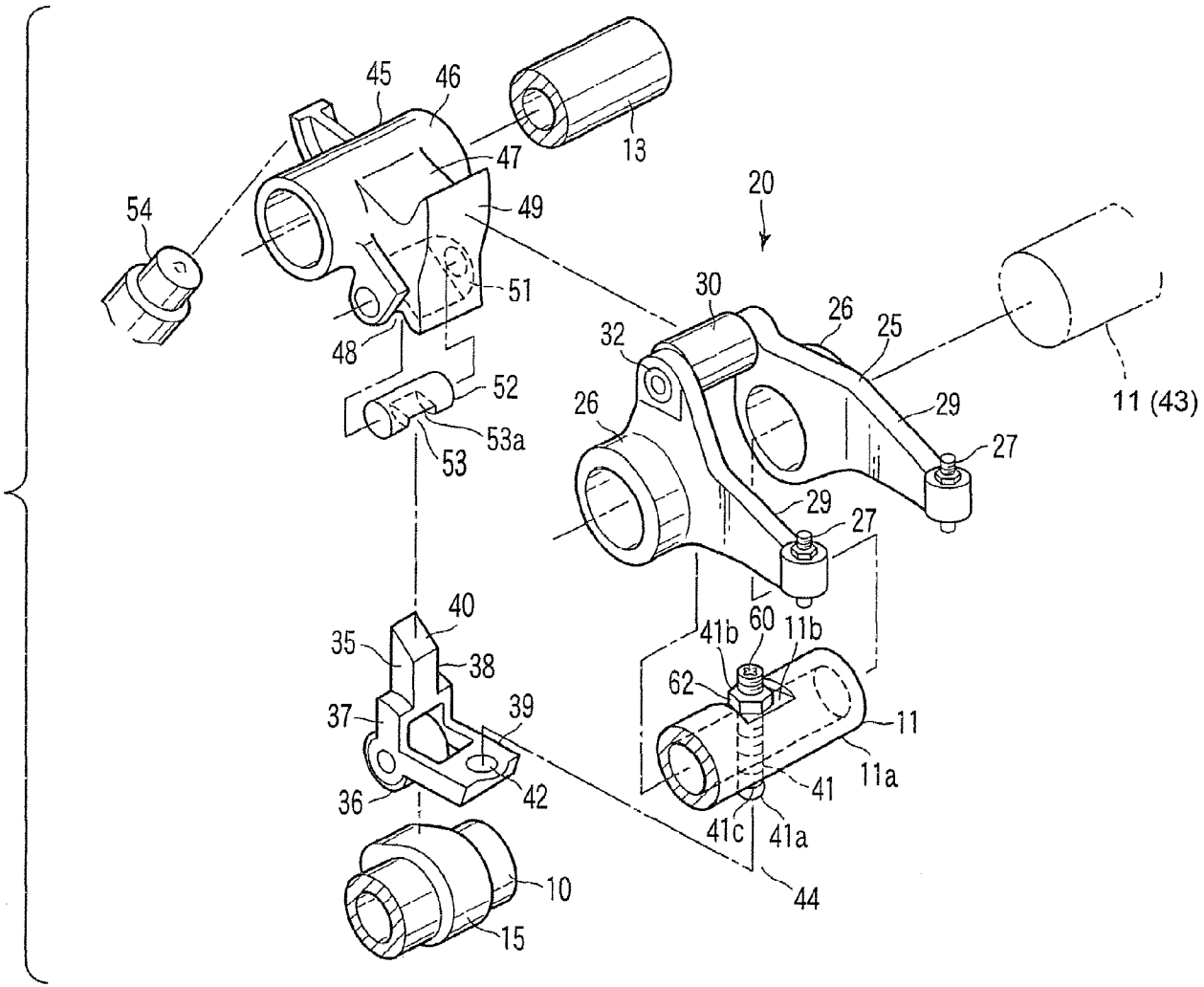
FIG. 3 is an exploded perspective view showing the variable valve unit shown in FIG. 1.

FIG. 2 is a top plan view showing the rocker arm mechanism 19. FIG. 3 is a exploded perspective view showing the rocker arm mechanism 19. As seen from FIG. 1 to FIG. 3, the rocker arm mechanism 19 includes rocker arm 25 as a first arm, center rocker arm 35 as a second arm, and swing cam 45 as a third arm.

The rocker arm 25 is swingably supported to the rocker shaft 11. The center rocker arm 35 is driven by the intake cam 15. The swing cam 45 swingably supported to the support shaft 13.

As shown in FIG. 3, the rocker arm 25 has a portion for transmitting displacement to the paired intake valves 5. The portion for transmitting displacement to the paired intake valves 5 is formed into a forked shape, for example.

The rocker arm 25 includes a pair of rocker arm members 29. The rocker arm member 29 is formed with a rocker shaft support boss 26 at the center. The rocker shaft support boss 26 has a cylinder, for example. The rocker arm members 29 are arranged in parallel with each other.

The rocker arm member 29 is provided with an adjust screw portion 27 at one end portion. The adjust screw portion 27 is one example of a drive part for driving the intake valve 5. A roller member 30 is held between the other end portions of the rocker arm members 29. The roller member 30 is rotatably supported by a support shaft 32. The roller member 30 functions as a contact element. The foregoing structure is given, and thereby, the portion for transmitting displacement to the paired intake valves 5 is formed into a forked shape.

The rocker shaft 11 is inserted into the rocker shaft support boss 26 of the assembled rocker arm 25 so that the rocker arm 25 is swingable. In this case, the roller member 30 is oriented to the center of the cylinder head 1.

One adjust screw portion 27 is arranged on the upper end portion of one intake valve 5. The valve upper end implies a valve stem end. The upper end portion of one intake valve 5 projects from the upper portion of the cylinder head 1.

The other adjust screw portion 27 is arranged on the upper end portion of the other intake valve 5. The valve upper end implies a valve stem end. The upper end portion of the other intake valve 5 projects from the upper portion of the cylinder head 1.

As seen from FIG. 1 and FIG. 3, the center rocker arm 35 is approximately L-shaped. The center rocker arm 35 has a cam follower 36 and a frame-shaped holder portion 37 rotatably supporting the cam follower 36. The cam follower 36 is one example of a rolling contact element, which rolls in contact with the cam surface of the intake cam 15. Incidentally, the cam 15 and the cam follower 36 abut against each other at a drive point P.

Specifically, the center rocker arm 35 has relay arm portion 38 and fulcrum arm portion 39. The relay arm portion 38 has a pillar shape extending upwardly from the holder portion 37 using the cam follower 36 as the center. Specifically, the relay arm portion 38 extends toward between the rocker shaft 11 and the support shaft 13.

The fulcrum arm portion 39 has a flat plate extending to the lower side of a rocker shaft portion 11*a*. As shown in FIG. 5 to FIG. 8, in rocker shaft 11, the rocker shaft portion 11*a* is a portion exposed from between one rocker arm member 29 and the other rocker arm member 29.

The foregoing structure is given, and thereby, the center rocker arm 35 is formed into an L-shape.

As illustrated in FIG. 3, the tip end of the relay arm portion 38 is formed with an inclined plane 40. The inclined plane 40 functions as a drive plane for transmitting displacement to the swing cam 45. For example, the inclined plane 40 is lower on the side of the rocker shaft 11. On the other hand, the inclined plane 40 is higher on the side of the support shaft 13. Thus, the inclined plane 40 is inclined.

The tip end of the fulcrum arm portion 39 is supported to the rocker shaft portion 11*a*. As seen from FIG. 1, FIG. 3 and FIG. 8, a structure supporting the fulcrum arm portion 39 to the rocker shaft portion 11*a* includes lock nut 41*b* and pin member 41 as a relay member, for example.

The pin member 41 is formed with a spherical portion 41*a* at the lower portion. The pin member 41 is formed with an external thread portion 41*c* at the outer circumferential surface. The external thread portion 41*c* is formed with an external thread.

The pin member 41 penetrates through the rocker shaft portion 11*a* from a setting seat 11*b* of the rocker shaft portion 11*a* to the lower side toward the tip end of the fulcrum arm portion 39. The rocker shaft portion 11*a* is formed with the setting seat 11*b* at the upper portion. The setting seat 11*b* is formed in a manner that the upper portion of the rocker shaft portion 11*a* is notched.

In the rocker shaft portion 11*a*, a hole through which the pin member 41 penetrates is formed with an internal thread portion engaging with the external thread portion 41*c*. By doing so, the pin member 41 is engaged with the rocker shaft portion 11*a*. The lock nut 41*b* clamps a portion projected from the setting seat 11*b* to upper side in the pin member 41. The pin member 41 is clamped using the lock nut 41*b*, and thereby, fixed to the rocker shaft portion 11*a*. The spherical portion 41*a* of the pin member 41 is projected from the lower portion of the rocker shaft portion 11*a*.

The fulcrum arm portion 39 is formed with a receiver portion 42 at the upper surface of the tip end. The receiver portion 42 has a semi-spherical shape. The spherical portion 41*a* projecting from the rocker shaft portion 11*a* is rotatably fitted into the receiver portion 42.

The foregoing structure is given, and thereby, when the intake cam 15 drives the cam follower 36, the center rocker arm 35 is vertically swingable with a pivot portion where the spherical portion 41*a* is fitted into the receiver portion 42 as a fulcrum P1.

The end portion of the rocker shaft 11 is connected with a control actuator, that is, control motor 43. The control motor 43 is actuated, and thereby, the rocker shaft 11 is desirably rotated.

Figure 5:
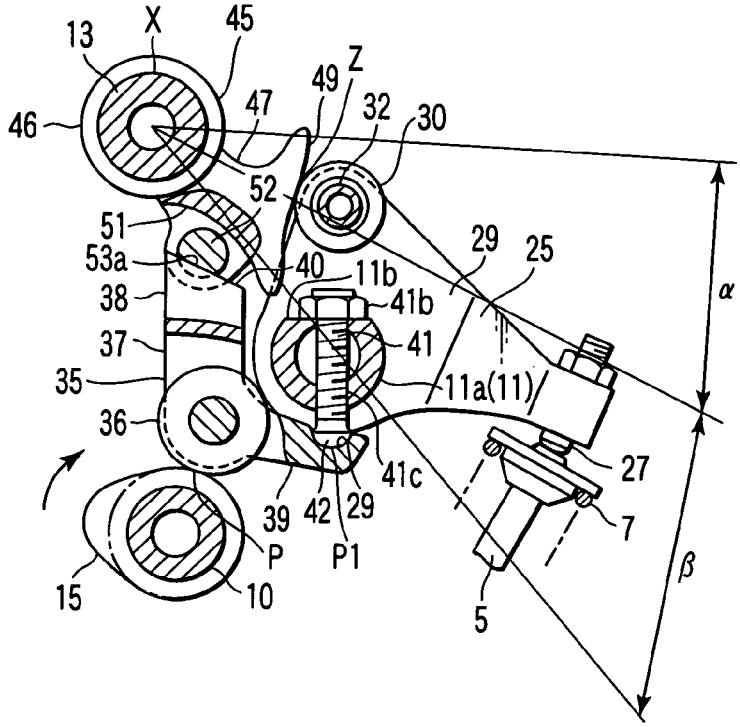
FIG. 5 is a cross-sectional view showing a state that a cam surface abuts against an abutting portion of a rocker arm in a base circle interval in the maximum valve lift control timing of the variable valve unit shown in FIG. 1.
Figure 6:
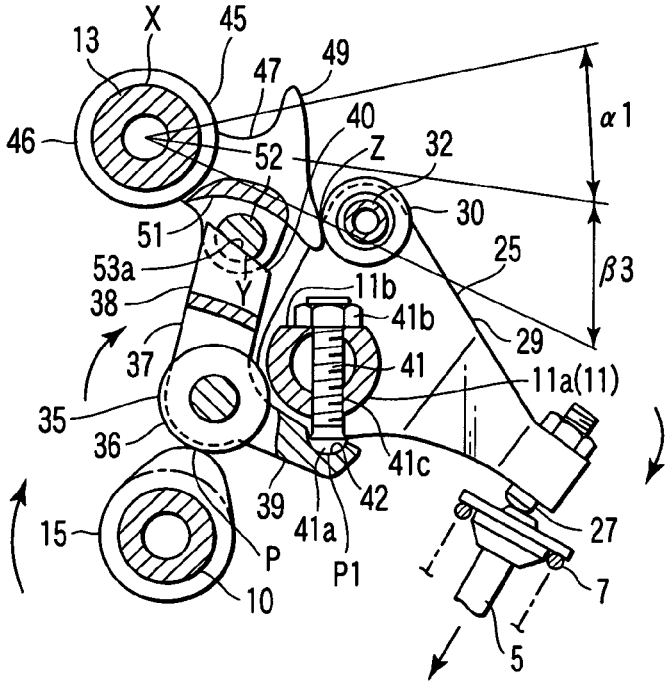
FIG. 6 is a cross-sectional view showing a state that a cam surface abuts against an abutting portion of a rocker arm in a lift interval in the maximum valve lift control timing of the variable valve unit shown in FIG. 1.
Figure 7:
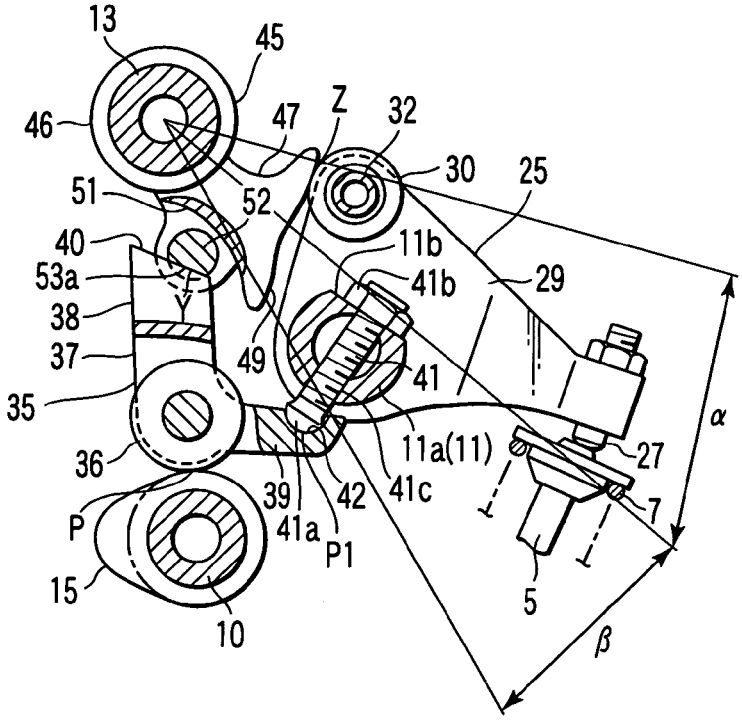
FIG. 7 is a cross-sectional view showing a state that a cam surface abuts against an abutting portion of a rocker arm in a base circle interval in the minimum valve lift control timing of the variable valve unit shown in FIG. 1.
Figure 8:
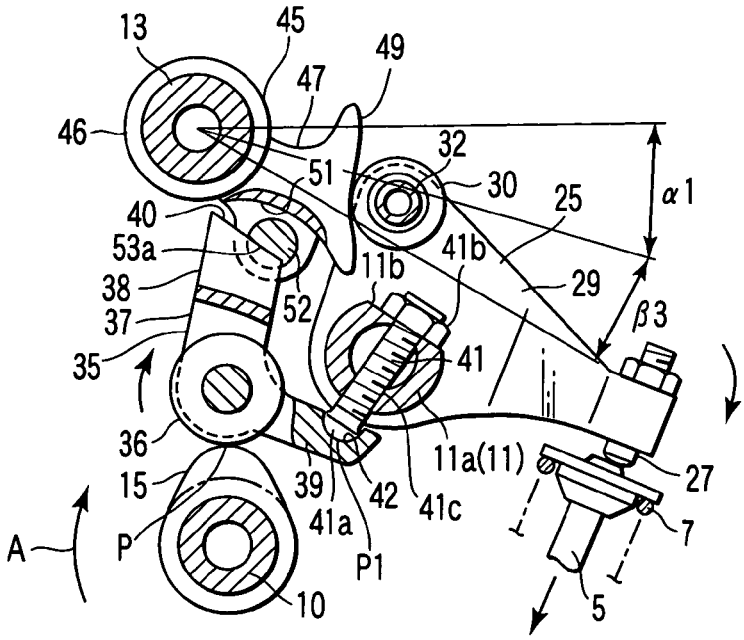
FIG. 8 is a cross-sectional view showing a state that a cam surface abuts against an abutting portion of a rocker arm in a lift interval in the minimum valve lift control timing of the variable valve unit shown in FIG. 1.

More specifically, the rocker shaft 11 is rotatable within a range described below. Namely, the rocker shaft 11 is rotatable within a range from a state that the pin member 41 is approximately vertical as shown in FIG. 5 and FIG. 6 to a state that the pin member 41 is inclined to the rotating direction of the camshaft 10 as shown in FIG. 7 and FIG. 8.

The control motor 43 and the pivot support structure forms a fulcrum moving mechanism 44. The fulcrum moving mechanism 44 is one example of a variable mechanism. The fulcrum moving mechanism 44 is used, and thereby, the fulcrum of the rocker shaft 11 side of the center rocker arm 35 is displaced to a direction crossing the axial direction of the rocker shaft 11. The fulcrum of the rocker shaft 11 side of the center rocker arm 35 is the pivot portion where the spherical portion 41*a* is fitted into the receiver portion 42. The fulcrum of the rocker shaft 11 side of the center rocker arm 35 is displaced, and thereby, the state and position of the center rocker arm 35 changes.

As depicted in FIG. 5 to FIG. 8, the center rocker arm 35 is shifted in its position, and thereby, the position of the cam follower 36 rolling contact with the intake cam 15 is variable. Namely, the position of the cam follower 36 abutting with the intake cam 15 is variable. In other words, the foregoing positional shift of the center rocker arm 35 is used, and thereby, the position of the cam follower 36 rolling contact with the intake cam 15 is variable.

The position of the cam follower 36 rolling contact with the intake cam 15 is displaced front and back in the rotating direction of the intake cam 15.

As seen from FIG. 3, the swing cam 45 has boss portion 46, arm portion 47, displacement receiver portion 48. The boss portion 46 has a cylinder shape through which the support shaft 13 is rotatably inserted. Thus, the swing cam 45 is rotatable with respect to the support shaft 13.

The arm portion 47 extends from the boss portion 46 toward the roller member 30. The displacement receiver portion 48 is formed at the lower portion of the arm portion 47.

The tip end of the arm portion 47 is formed with a cam surface 49. The cam surface 49 functions as a transmission surface portion for transmitting displacement to the rocker arm 25. The cam surface 49 extends vertically, for example. The cam surface 49 is rolled in contact with the outer peripheral surface of the roller member 30.

The displacement receiver portion 48 has recess portion 51 and short shaft 52 as a shaft member. The recess portion 51 is formed at the lower portion of the arm portion 47 and just over the camshaft 10. The short shaft 52 is received in the recess portion 51 in the same direction as the shafts 10 and 11. The short shaft 52 is rotatable. The short shaft 52 is rotatably located in the swingable direction of the swing cam 45.

The lower portion of the short shaft 52 exposing from the opening portion of the recess portion 51 is formed with a recess portion 53, for example. The tip end of the relay arm portion 38 is slidably inserted into the recess portion 53. The tip end portion of the relay arm portion 38 is the tip end portion of the center rocker arm 35.

The bottom of the recess portion 53 is formed with a receiver surface 53*a*. The receiver surface 53*a* functions as a driven surface. The receiver surface 53*a* is flat. The receiver surface 53*a* contacts with the inclined plane 40. The receiver surface 53*a* and the inclined plane 40 are mutually slidable.

The foregoing structure is given, and thereby, the swing cam 45 is periodically swingable when receiving the displacement of the center rocker arm 35 by swing. In this case, the support shaft 13 functions as the fulcrum X. The recess portion 53 functions as the effort point Y for receiving a load from the center rocker arm 35. The cam surface 49 functions as the load point Z for driving the rocker arm 25.

When the cam follower 36 is displaced from a predetermined position of the intake cam 15 to an advance or late angle direction, the position of the swing cam 45 changes with the displacement. When the position of the swing cam 45 changes, a phase of the intake cam 15 is shifted to an advance or late angle direction.

The cam follower 36 has displaced from a predetermined position of the intake cam 15 to an advance or late angle direction. This implies that the center rocker arm 35 is displaced front and back in the moving direction of the intake cam 15.

The cam surface 49 is a curved surface in which the distance from the center of the support shaft 13 is different. This point will be explained below. As shown in FIG. 1, the upper portion of the cam surface 49 is situated on the base circle interval α. The lower portion of the cam surface 49 is situated on the lift interval β. The lift interval β functions as a conversion section.

The base circle interval α is an arc surface around the axis of the support shaft 13. Thus, in the base circle interval α, the distance from the axis of the support shaft 13 is equal in any places. The lift interval β continues to the base circle interval α. The lift interval β has arc surfaces β1 and β2. The arc surface β1 continues to the base circle interval α. The arc surface β1 is an arc surface reverse to the base circle interval α. The arc surface β2 continues to the arc surface β1. The arc surface β1 is an arc surface reverse to the arc surface β1. The lift interval β is an arc surface having the same cam shape as the lift area of the intake cam 15. The lift interval β has the same function as the lift area of the intake cam 15.

When the cam follower 36 is displaced from the predetermined position of the intake cam 15 to the advance angle direction, the area of the cam surface 49 contacting with the roller member 30 changes. As described above, the cam follower 36 is displaced from the predetermined position of the intake cam 15 to the advance angle direction. This means that the fulcrum position of the center rocker arm 35 is displaced.

Specifically, a ratio changes between intervals α1 and β3 given below. The interval α1 is an interval where the roller member 30 actually reciprocates in the vase circle interval α. The interval β3 is an interval where the roller member 30 actually reciprocates in the lift interval β.

With the change of the ratio of the intervals α1 and β3, the opening and closing timing of the intake valve 5 is continuously variable while valve opening timing is maintained. Simultaneously, the valve lift of the intake valve 5 is continuously variable.

The upper end portion of the pin member 41 is formed with a groove 60. The groove 60 is one example of a receiver for receiving a rotating operation. The groove 60 has a plus shape. Engaging structure of the pin member 41 with the lock nut 41*b* and the pin member 41 with the rocker shaft portion 11*a* form an adjustment mechanism 62. The adjustment mechanism 62 is used, and thereby, the valve opening timing of the intake valve 5 is adjusted for each cylinder.

The method of adjusting the valve opening timing of the intake valve 5 will be explained below.

Figure 4:
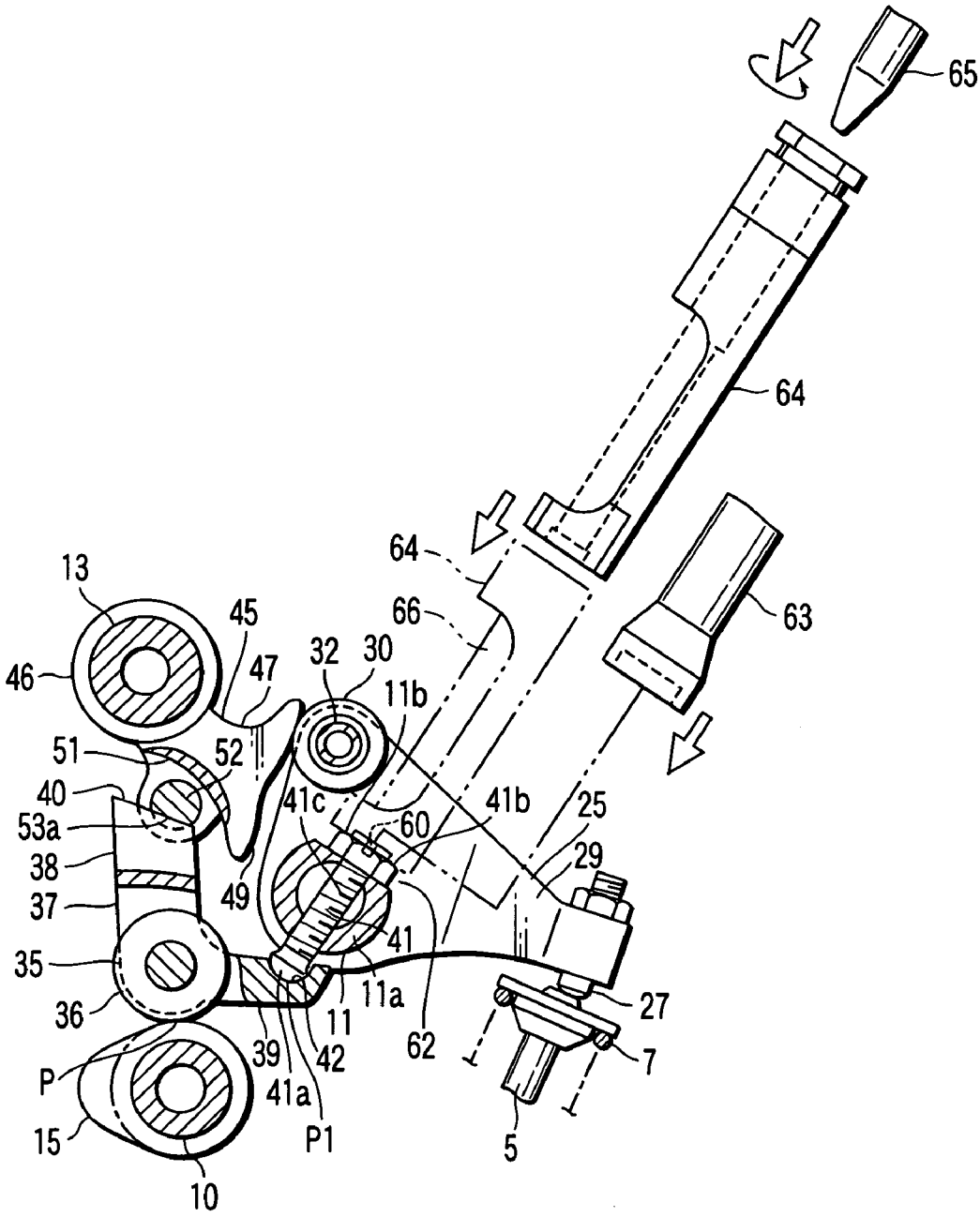
FIG. 4 is a cross-sectional view to explain a state of adjusting the variable valve unit shown in FIG. 1.

As illustrated in FIG. 4, in a non-actuation of the engine 100, the pin member 41 is positioned in a direction which does not disturb the work. The lock nut 41*b* is unlocked using a nut tool 63, for example. After the lock nut 41*b* is unlocked, the pin member 41 is rotated using a screwdriver guide jig 64 and a plus type driver 65. The pin member 41 is rotated, and thereby, the projection from the setting seat 11*b* is varied in the pin member 41.

In the pin member 41, the projection from the setting seat 11*b* to upper side is varied, and thereby, the position and postures of the rocker arm 35 and the swing cam 45 are changed. The positions and postures of the rocker arm 35 and the swing cam 45 are changed, and thereby, the valve opening timing of the intake valve 5 is adjusted.

As shown in FIG. 1, the cylinder head 1 is provided with pusher 54 and ignition plug 55. The pusher 54 urges the swing cam 45. The pusher 54 urges the swing cam 45 to urge the rocker arm 25 and the center rocker arm 35 to a mutually closing direction. The ignition plug 55 ignites a fuel-air mixture in the combustion chamber 2.

The operation of the variable valve unit 20 having the structure given above will be explained.

First, the motion of the rocker arm mechanism 19 involved with the open and close operations of the intake valve 5 will be explained below. As seen from FIG. 1, the camshaft 10 rotates in the direction shown by the arrow A.

The cam follower 36 of the center rocker arm 35 contacts with the intake cam 15 arranged between one rocker arm member 29 and the other rocker arm member 29. The cam follower 36 is driven along a cam profile of the intake cam 15.

The center rocker arm 35 is vertically swingable with the pivot portion as the fulcrum. The displacement by the swing is transmitted to the swing cam 45 just over the center rocker arm 35.

One end of the swing cam 45 is swingably supported to the support shaft 13. The other end of the swing cam 45 is rolled in contact with the roller member 30 of the rocker arm 25. The receiver surface 53*a* formed in the rotatable short shaft 52 contacts with the inclined plane 40 formed at the tip end of the relay arm portion 38.

By doing so, the swing cam 45 is pushed up or down using the inclined plane 40 while sliding on the inclined plane 40. The behavior is repeated. Thus, the swing cam 45 is swingable. The swing cam 45 is swingable, and thereby, the cam surface 49 is vertically driven.

The roller member 30 is rolled in contact with the cam surface 49. Thus, the roller member 30 is periodically pressed against the cam surface 49. The rocker arm 25 is pressed by the cam surface 49, and thereby, driven with the rocker shaft 11 as the fulcrum. Thus, the rocker arm 25 is swingable with the rocker shaft 11 as the fulcrum. The rocker arm 25 is swung, and thereby, the paired intake valve 5 is opened and closed at a time.

During running, the rocker shaft 11 is rotated, and thereby, the pivot portion of the center rocker arm 25 is moved to a point where the maximum valve lift is maintained, for example. The rocker shaft 11 is rotated by the control motor 43.

As described above, the pivot portion of the center rocker arm 25 is moved to the point where the maximum valve lift is maintained. In the foregoing process, the cam follower 36 is displaced on the cam surface of the intake cam 15 with a positional change of the center rocker arm 35.

The swing cam 45 is displaced to a position such that the cam surface 49 becomes approximately vertical state when the roller member 30 is in a sate of rolling in contact with the base circle interval α as shown in FIG. 5 and FIG. 6.

Thus, the position of the cam surface 49 is set so that the valve lift becomes the maximum. In other words, the area of the cam surface 49 where the roller member 30 reciprocates is set so that the valve lift becomes the maximum.

Specifically, as shown in FIG. 5, the interval α1 where the roller member 30 actually reciprocates is set to the shortest distance in the base circle interval α. As shown in FIG. 6, the interval β3 where the roller member 30 actually reciprocates is set to the longest distance in the lift interval β.

The rocker arm 25 is driven via the cam surface part formed by the intervals α1 and β3 where the roller member 30 actually reciprocates. Thus, the intake valve 5 is opened and closed via the rocker arm 25. In this case, the valve lift of the intake valve 5 becomes the maximum as seen from A1 shown in a graph of FIG. 9. The intake valve 5 is opened and closed at a desired opening and closing timing.

In order to vary a phase of the intake cam 15 from the foregoing state, the control motor 43 rotates the rocker shaft 11. Specifically, the rocker shaft 11 is rotated from the position where the maximum valve lift is maintained to a clockwise direction as depicted in FIG. 5 and FIG. 6. By doing so, the pivot portion of the center rocker arm 35 is shifted to the side of the camshaft 10. The pivot portion is the fulcrum position of the center rocker arm 35.

The inclined plane 40 of the relay arm portion 38 and the receiver surface 53*a* of the short shaft 52 contact with each other. A position of the center rocker arm 35 contacting with the intake cam 15 is formed in the cam follower 36 rolling in contact with the intake cam 15.

When the foregoing shift is transmitted to the center rocker arm 35, the position of the cam follower 36 rolling in contact with the cam 15 is shifted to the advance angle direction of the intake cam 15. Thus, the position of the center rocker arm 35 is shifted.

The position of the cam follower 36 rolling in contact with the cam 15 is shifted to the advance angle direction, and thereby, the valve opening timing of the intake valve 5 is brought forward. Namely, the valve opening timing of the intake valve 5 is brought forward in accordance with the variable of the pivot portion of the center rocker arm 35.

The inclined plane 40 displaces the receiver surface 53*a* from the initial position to the advance angle direction by the foregoing shift of the fulcrum position. To displace is to slide. Thus, the swing cam 45 changes into a state that the cam surface 49 of the swing cam 45 is inclined to the lower side as illustrated in FIG. 7 and FIG. 8.

When the inclination of the cam surface 49 gradually becomes large, the interval α1 where the roller member 30 actually reciprocates gradually becomes long in the base circle interval α. On the other hand, the interval β3 where the roller member 30 actually reciprocates gradually becomes short in the lift interval β. Then, the cam profile of the cam surface 49 thus varied is transmitted to the roller member 30. Thus, the rocker arm 25 makes early the valve opening timing of the intake valve.

Even if the setting of the variable valve unit 20 changes between states that the valve lift of the intake valve 5 is the maximum and that it is the minimum, the opening timing of the intake valve 5 becomes substantially the same in each state.

The closing timing is continuously varied and controlled. FIG. 7 and FIG. 8 shows a state that the valve lift of the intake valve 5 is the minimum.

Figure 9:
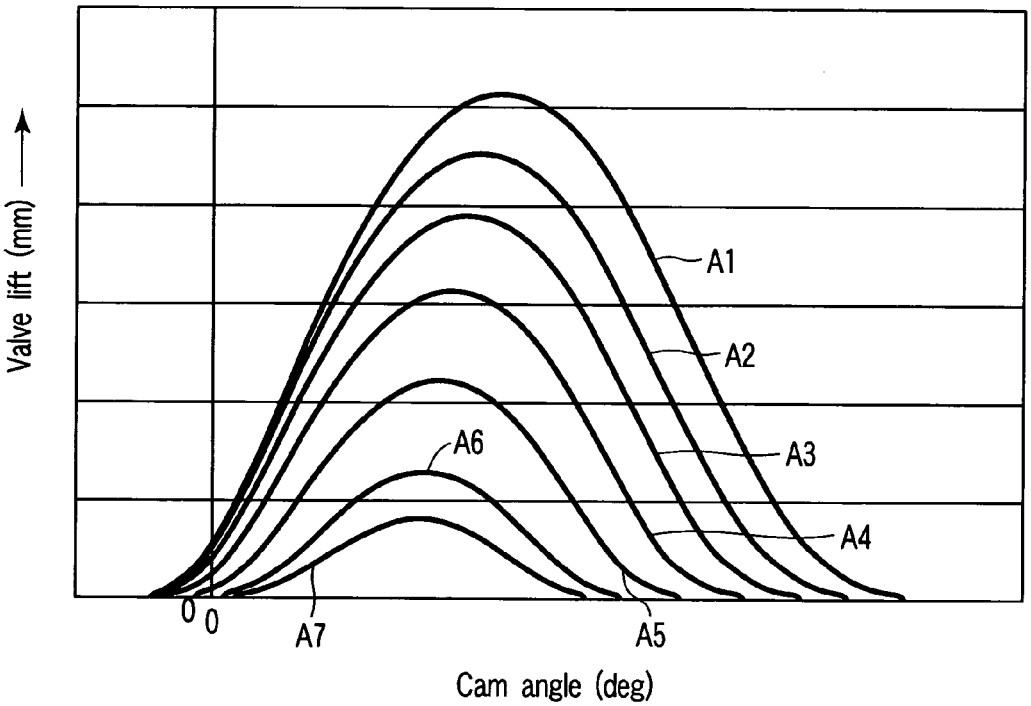
FIG. 9 is a graph to explain the performance of the variable valve unit shown in FIG. 1.

The state that the valve lift of the intake valve 5 is the maximum is a state of A1 of FIG. 9. The state that the valve lift of the intake valve 5 is the minimum is a state of A7 of FIG. 9. In FIG. 9, A2 and A6 shows an intermediate state in the states from A1 to A7.

As described above, the rocker arm mechanism 19 combined the rocker arm 25, center rocker arm 35 and swing cam 45 is only used, and thereby, the cam phase is variable so that the valve-closing timing changes greatly.

Particularly, in the fulcrum moving mechanism 44, the pin member 41 is provided in the rotatable rocker shaft 11. The end portion of the pin member 41 is supported to the fulcrum portion of the center rocker arm 35. Therefore, the number of components of the fulcrum moving mechanism 44 is reduced. Moreover, the occupied area of the fulcrum moving mechanism 44 is reduced. Thus, the fulcrum moving mechanism 44 has a simple and compact structure. As a result, the variable valve unit 20 becomes compact.

The distance from the support shaft 13 to the lift interval β of the cam surface 49 changes depending on places in the lift interval β. Thus, the swing cam 45 continuously varies a cam phase transmitted to the rocker arm 25 together with the valve lift.

Thus, the opening and closing timing of the intake valve 5 and the valve lift are varied, thereby largely changing the valve-closing timing as compared with the valve opening timing, and the foregoing variations are continuously and simultaneously made.

The opening and closing timing and the valve lift are continuously varied, and thereby, intake air is supplied into cylinders without loss. Thus, pumping loss is reduced.

Even if the variable valve unit 20 is built in the cylinder head 1, the valve opening timing for each cylinder is readily adjusted via the adjustment mechanism 62. Namely, the shift of the valve opening timing for each cylinder is reduced.

The valve opening timing is adjusted a non-actuation state of the engine. As shown in FIG. 4, the pin member 41 is positioned in a state of not disturbing the work. For example, the pin member 41 is positioned in a state that the head of the lock nut 41*b* is interposed between one and the other rocker arm members 29.

The posture of the pin member 41 in a state that the head of the pin member 41 is interposed between one rocker arm member 29 and the other rocker arm member 29 is that the pin member 41 is positioned in a state of inclined at angle of 45° approximately as shown in FIG. 4. The position of the pin member 41 is changed with the rotation of the rocker shaft 11.

The tip end of the nut tool 63 is fitted into the lock nut 41*b* through a space between one and the other rocker arm members 29. The lock nut 41*b* is loosened with the rotation of the nut tool 63.

Then, the tip end of the screwdriver guide jig 64 is fitted into the end portion of the pin member 41 through the space between one and the other rocker arm members 29. By doing so, a guide path 66 is formed as shown by a chain double-dashed line in FIG. 4. The guide path 66 extends from the back end of the screwdriver guide jig 64 to the end of the pin member 41. The guide path 66 guides a screwdriver 65 to the end portion of the pin member 41.

The screwdriver 65 is inserted through the guide path 66. The tip end of the screwdriver 65 is inserted into the groove 60 of the pin member 41. Incidentally, the screwdriver has a plus-shaped tip. Of course, the groove 60 has a plus shape. Thus, the tip end of the screwdriver 65 is inserted into the groove 60. The screwdriver 65 is rotated, and thereby, the pin member 41 is rotated. Therefore, the projection of the pin member 41 is adjusted.

The projection of the pin member 41 is adjusted, and thereby, the position and posture of the center rocker arm 35 and the swing cam 45 are changed. The position and posture of the center rocker arm 35 and the swing cam 45 are changed, and thereby, a drive position of the swing cam 45 for driving the center rocker arm 35 is adjusted. The drive position is a load point Z.

By doing so, a swingable range of each arm is adjusted. Thus, the valve opening timing of the intake valve 5 is adjusted for each cylinder.

Therefore, even after the variable valve unit 20 is built in the cylinder, the built-in state of components of the variable valve unit 20 and the valve opening and closing timing of each cylinder can be adjusted for each unit 20. The foregoing adjustment is made, and thereby, a combustion state of each cylinder becomes substantially uniform. In other words, there is no difference in the combustion state for each cylinder. As a result, vibration generated by the difference is reduced. In addition, the adjustment mechanism 62 has the structure in which the drive position of the swing cam 45 is adjusted with respect to the rocker arm 25. Thus, the structure is simplified. The drive position is the load point Z.

In particular, the adjustment mechanism 62 has the structure of directly adjusting the drive position with respect to the rocker arm 25. Thus, the drive position of the swing cam 45 with respect to the rocker arm 25 is relatively simple adjusted.

Moreover, the adjustment mechanism 62 has the structure of adjusting the projection of the pin member 41 to adjust the valve opening timing. Thus, the positional change of the center rocker arm 35 and the swing cam 45 when adjusting the valve timing is used for adjusting the valve opening timing. Therefore, the dispersion of the valve opening timing is corrected readily at every cylinder.

In particular, the adjustment mechanism 62 is provided at a portion, which does not link with the rotation of the camshaft 10. Thus, inertia weight in the valve actuation is reduced. As a result, the performance of the engine 100 is enhanced.

The adjustment mechanism 62 is provided effectively using the space of the variable valve unit 20. Thus, this serves to prevent the variable valve unit 20 from being made large.

Incidentally, a phase variable unit may be used together. In this case, phase variable is small. Thus, responsibility is enhanced. Also, fuel mileage is improved.

Figure 10:
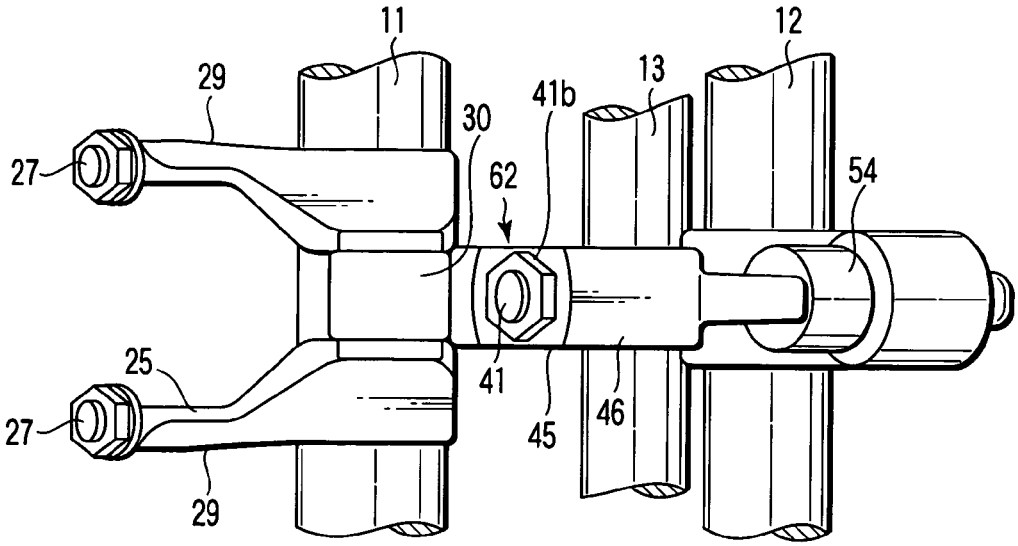
FIG. 10 is a top plan view showing principal parts of a variable valve unit according to a second embodiment of the present invention.
Figure 11:
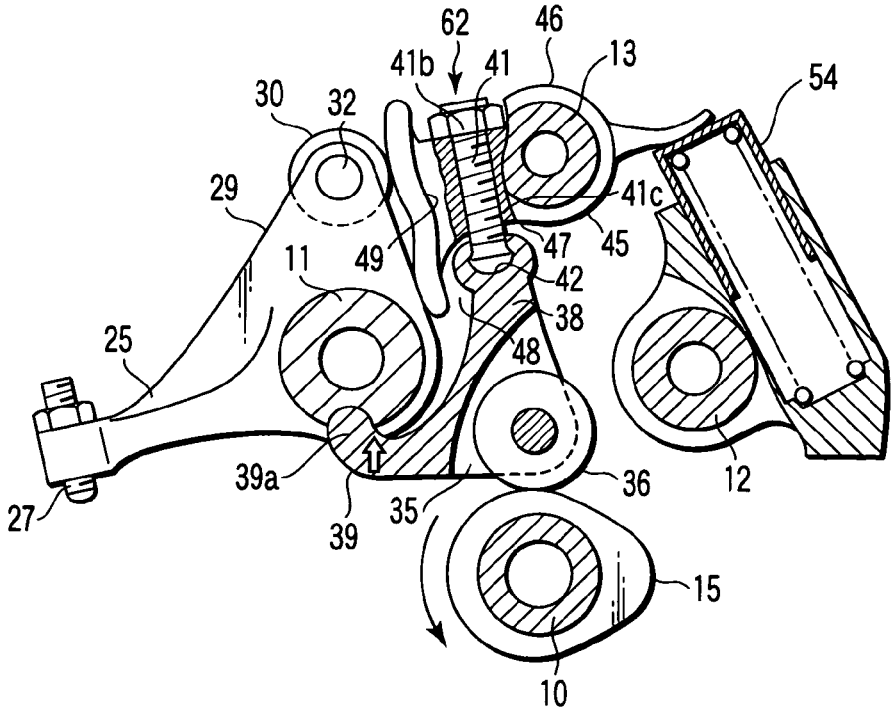
FIG. 11 is a cross-section view showing the variable valve unit shown in FIG. 10.

Principal parts of a variable valve unit according to a second embodiment of the present invention will be explained with reference to FIG. 10 and FIG. 11. The same reference numerals are used to designate components having the same function as the first embodiment, and the details are omitted.

According to the second embodiment, an adjustment mechanism 62 is provided in a movable part. Specifically, the adjustment mechanism 62 is provided in the swing cam 45.

The adjustment mechanism 62 of the second embodiment will be explained below specifically. As shown in FIG. 11, the tip end portion of the fulcrum arm portion 39 is provided with a lock portion 39*a*. The lock portion 39*a* is locked at the lower portion of the outer circumferential portion of the rocker shaft 11. Thus, the center rocker arm 35 is vertically swingable with the lock portion 39*a* as the fulcrum.

The pin member 41 extends from the upper side of the arm portion 47 of the swing cam 45 to the lower side. In the arm portion 47, a hole in which the pin member 41 is inserted is formed with an internal thread. Thus, the pin member 41 is screwed into the arm portion 47. In the pin member 41, a portion projecting from the upper portion of the arm portion 47 is clamped with the lock nut 41*b*. Thus, the pin member 41 is fixed to the arm portion 47.

The end portion of the relay arm portion 38 of the center rocker arm 35 is formed with a receiver portion 42. The receiver portion 42 has a semi-spherical shape. The spherical portion of the pin member 41 projecting from the lower portion of the swing cam 45 is fitted into the receiver portion 42 formed at the end portion of the relay arm portion 38.

According to the second embodiment, nut tool and plus screwdriver are used together during the non-actuation state of the engine 100, and thereby, the projection of the tip end of the pin member 41 is adjusted like in the first embodiment. Thus, the valve opening timing is adjusted. Therefore, according to the second embodiment, the same effect as the first embodiment is obtained.

In particular, the adjustment mechanism 62 is provided in the swing cam 45, and thereby, the adjustment mechanism 62 is readily accessed from above the engine 100. Thus, there is no interference with other components, and also, it is possible to prevent interference with other components in adjusting the adjustment mechanism 62. Thus, it is readily to adjust the built-in state of the adjusting mechanism.

Principal parts of a variable valve unit according to a third embodiment of the present invention will be explained with reference to FIG. 12 to FIG. 15. The same reference numerals are used to designate components having the same function as the first embodiment, and the details are omitted.

An adjustment mechanism 62 of the third embodiment differs from the first and second embodiments in its structure. Specifically, several other short shafts are used in addition to the short shaft 52 interposed between the center rocker arm 35 and the swing cam 45.

These several other short shafts have shape and height different from the short shaft 52. Moreover, other shafts have mutually different shape and height. In order to adjust the valve opening timing of several valves, the short shaft 52 is properly replaced with the other short shaft.

The foregoing point will be explained below. In the third embodiment, explanation will be made using the short shaft 52*a* as one example of the other short shaft.

As seen from FIG. 12 to FIG. 15, the lower portion of the swing cam 45 is formed with a through hole 51*a* into which short shaft 52 and the other short shaft different from the short shaft 52 are removably inserted.

Figure 12:
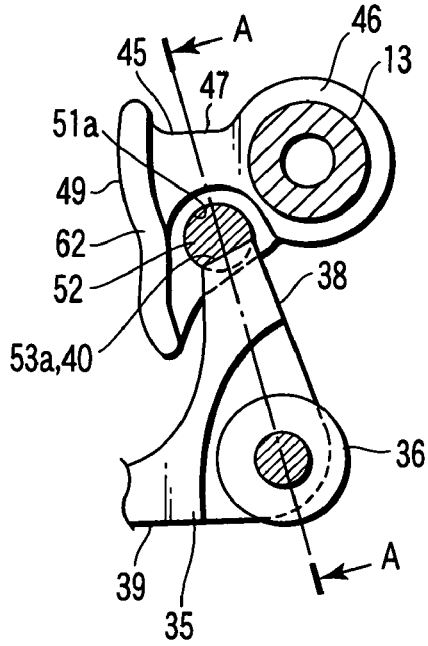
FIG. 12 is a cross-sectional view showing principal parts of a variable valve unit according to a third embodiment of the present invention.
Figure 13:
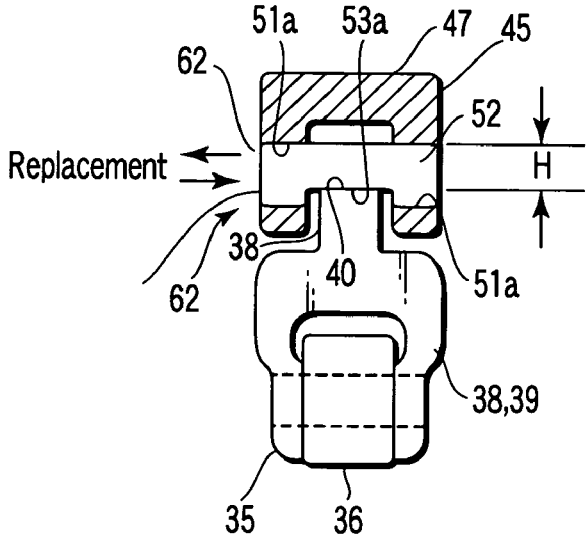
FIG. 13 is a cross-sectional view taken along a line A-A shown in FIG. 12.
Figure 14:
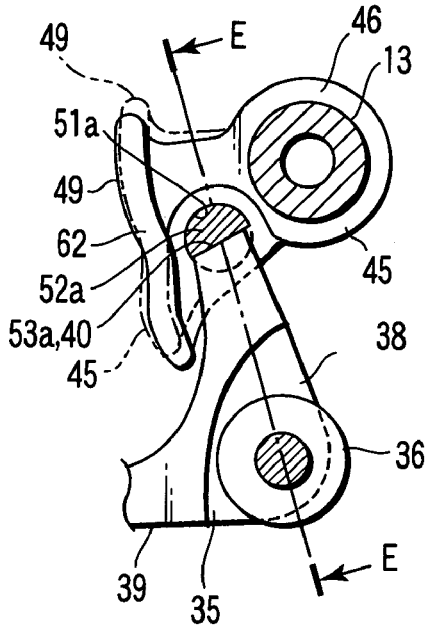
FIG. 14 is a cross-sectional view showing a state that a short shaft shown in FIG. 12 is replaced with another short shaft.
Figure 15:
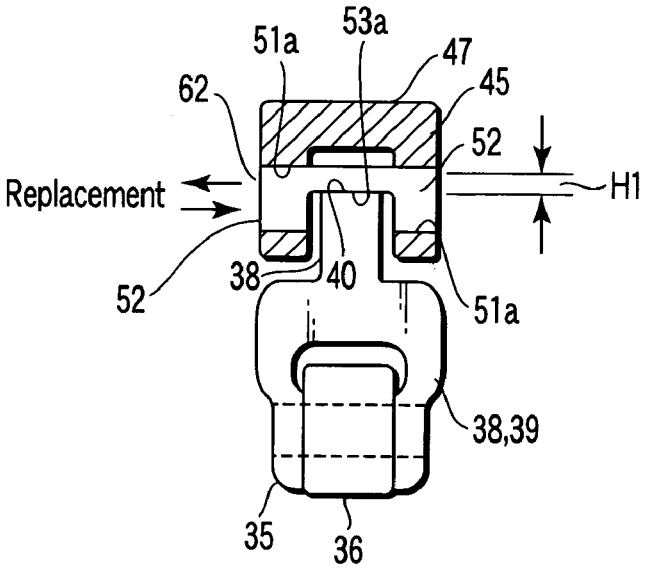
FIG. 15 is a cross-sectional view taken along a line E-E shown in FIG. 14.

In FIG. 12 and FIG. 13, the short shaft 52*a* is used. In FIG. 14 and FIG. 15, a short shaft 52*a* is used. The height dimension of a receiver surface 53*a* of the short shaft 52 is set to H. The height dimension of a receiver surface 53*a* of the short shaft 52*a* is set to H1.

As illustrated in FIG. 14, the short shaft 52 is replaced with the short shaft 52*a*, and thereby, a contact state of the inclined plane 40 of the center rocker arm 35 with the receiver surface 53*a* changes. In FIG. 14, a chain double-dashed line shows the position of the swing cam 45 when the short shaft 52 is used.

Thus, the short shaft 52 is replaced with the short shaft 52*a*, and thereby, the relative position of the swing cam 45 with respect to the rocker arm 35 changes. The drive position of the rocker arm 25 is adjusted using the foregoing change.

According to the third embodiment, the same effect as the first embodiment is obtained. In particular, the short shaft 52 is merely replaced to make adjustment using the adjustment mechanism 62 of the third embodiment. Therefore, the structure of the adjustment mechanism 62 is simple.

According to the third embodiment, the short shaft 52*a* is used as one of several other short shafts 52. However, the kind of the other short shaft is not limited to the short shaft 52*a*. Several kinds of short shafts are prepared corresponding to the drive position of a desired rocker arm 25.

A fourth embodiment of the present invention will be explained with reference to FIG. 16 to FIG. 21.

According to the fourth embodiment, components of the rocker arm mechanism 19 shown in the first embodiment are made into a modular unit. The foregoing point will be explained below.

As depicted in FIG. 18 to FIG. 21, a cylinder head 1 is formed with a support base 17 corresponding to portions of the camshaft 10. The portions of the camshaft 10 are both end portions of the axial direction of the camshaft 10, shaft portion between cylinders, etc.

The support base 17 has a wall shape extending in the widthwise direction of the cylinder head 1. The support base 17 has a bearing portion 17*a* for supporting the camshaft 10. The portions of the camshaft 10 are rotatably supported to the support base 17.

Figure 16:
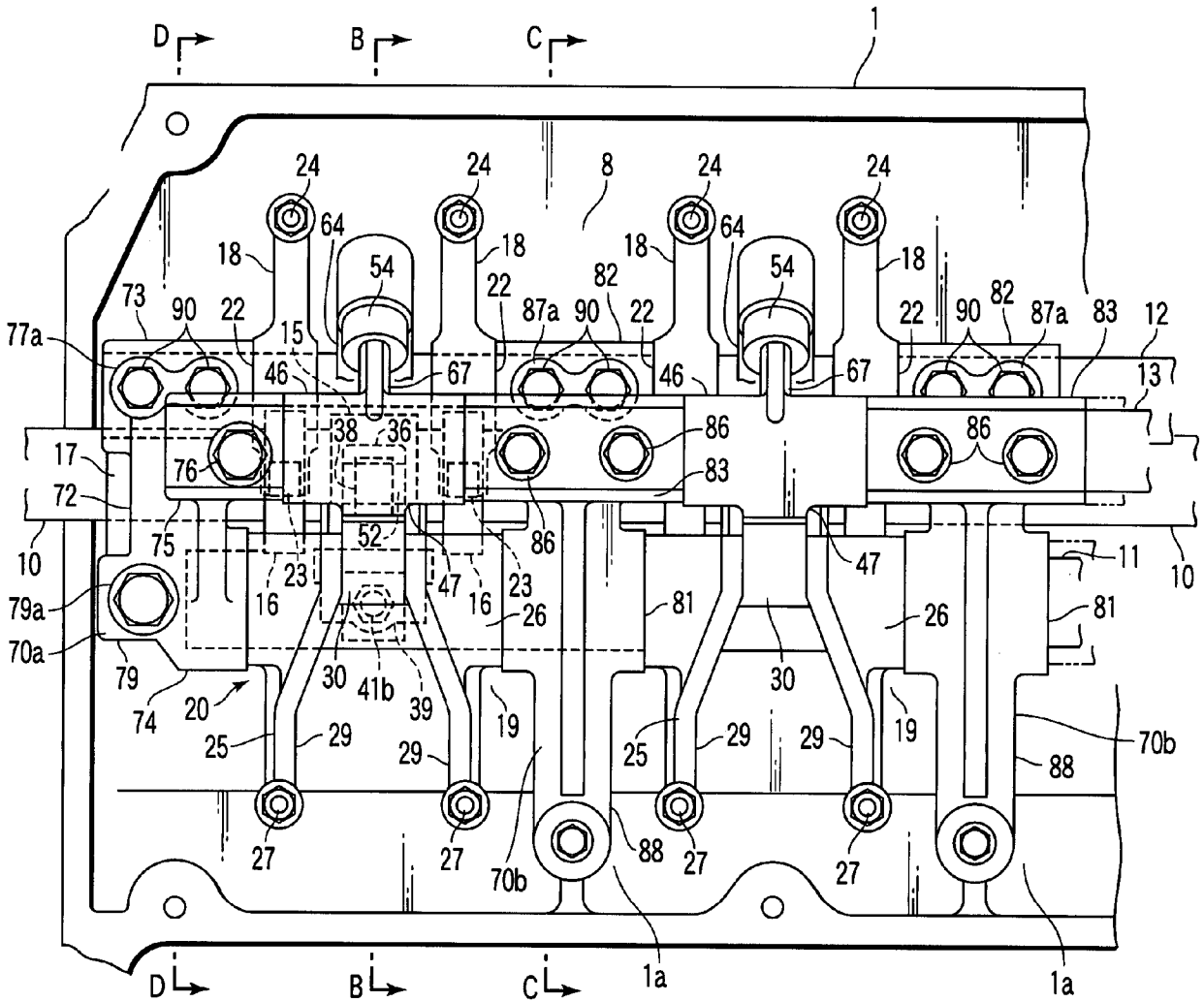
FIG. 16 is a top plan view showing a variable valve unit according to a fourth embodiment of the present invention together with a cylinder head attached with the same unit.
Figure 17:
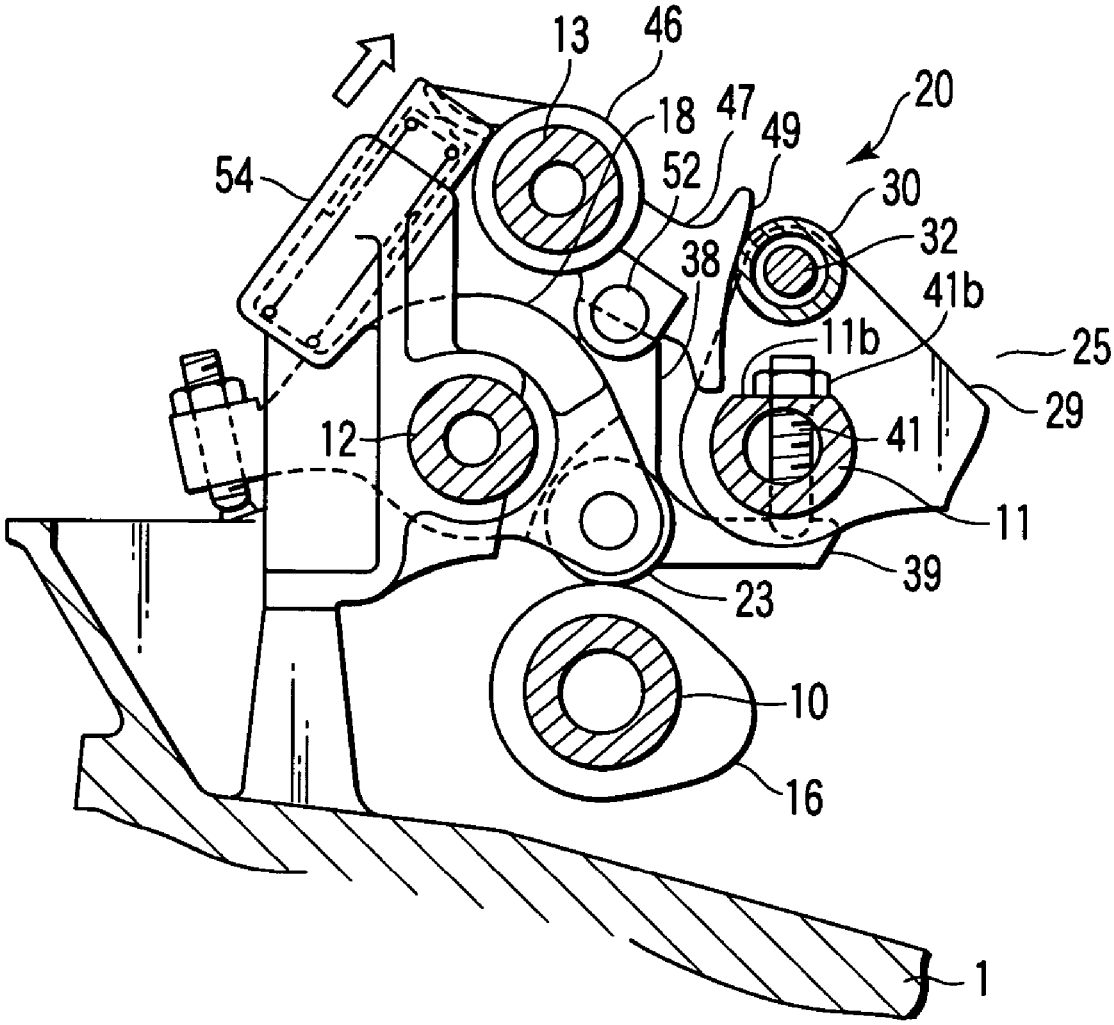
FIG. 17 is a cross-sectional view taken along a line B-B shown in FIG. 16.

As illustrated in FIG. 16, two kinds of retainer members 70*a* and 70*b* hold each portion of the rocker shaft 11, the rocker shaft 12 and the support shaft 13 of the valve system 8.

The foregoing each portion of shafts 11 to 13 described below. One of the portions is both end portion of the axial direction, and another is a portion between cylinders in shafts 11 to 13. Another is a portion adjacent to the intake-side rocker arm mechanism 19 and the exhaust-side paired rocker arm 18. Another is a portion between the intake-side rocker arm mechanism 19 and the exhaust-side paired rocker arm 18.

The retainer structure of the foregoing shafts 11 to 13 will be explained below. A retainer member 70*a* is a component suitable to a place where a space for fixation is secured near the rocker shaft 11. The retainer member 70*a* is suitable to holding a shaft end, for example.

A retainer member 70*b* is a component suitable to a place where a space for fixation is hard to be secured near the rocker shaft 11. The retainer member 70*b* is suitable to holding a shaft portion between cylinders, for example.

Figure 20:
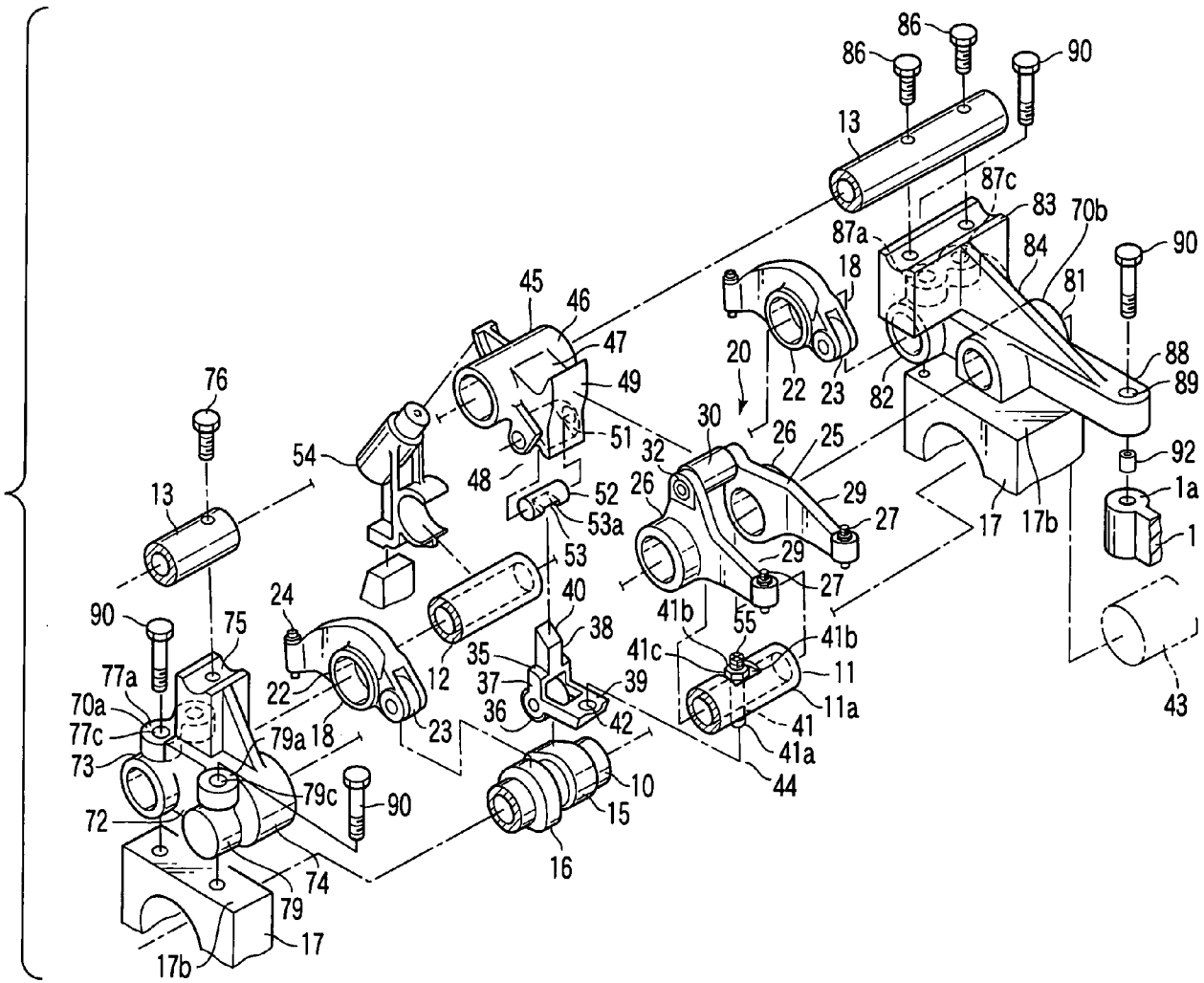
FIG. 20 is an exploded perspective view showing a valve system shown in FIG. 16.

As shown in FIG. 20, the retainer member 70*a* has a main body 72. The main body 72 is placed on the support base 17 arranged at the longitudinal direction end of the cylinder head 1. In FIG. 20, there is shown the retainer member 70*a* placed on the support base 17 arranged at one end of the cylinder head 1. The main body 72 is formed with fitting portions 73 and 74 at the side portions.

The fitting portion 73 is formed into a cylinder shape for receiving the exhaust rocker shaft 12. On the other hand, the fitting portion 74 is formed into a cylinder with bottom for rotatably receiving one end of the exhaust rocker shaft 11.

The main body 72 is provided with a pillar receiver portion 75. The receiver portion 75 extends upwardly from between the fitting portions 73 and 74. The receiver portion 75 supports the lower side of the support shaft 13.

The support shaft 13 is fixed to the receiver portion 75 via a clamp tool. The clamp tool penetrates through the support shaft 13 from the top. The clamp tool is screwed into the receiver portion 75. For example, a bolt member 76 is given as one example of the clamp tool.

The foregoing structure is given, and thereby, the end portion of the support shaft 13 and the end portions of both rocker shafts 13 and 14 are held via the retainer member 70*a* in a state of mutually keeping a predetermined space.

Figure 19:
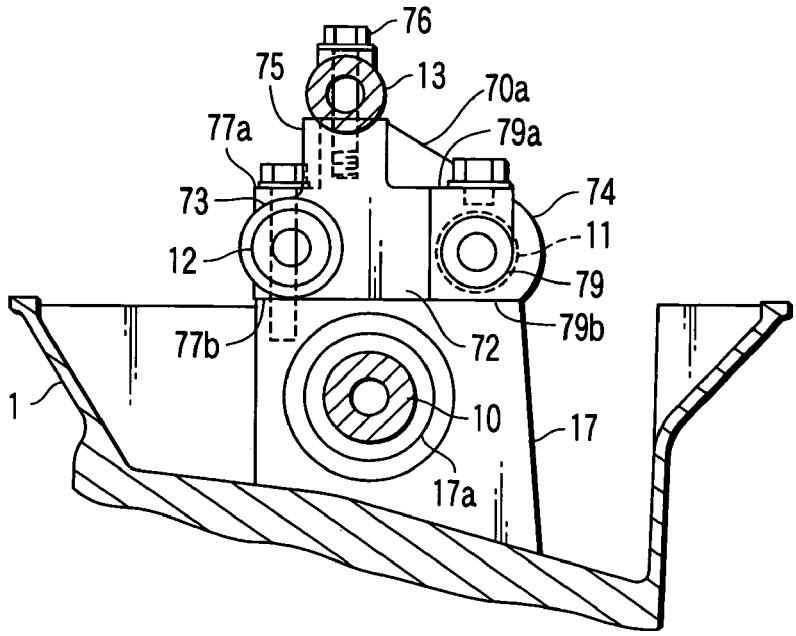
FIG. 19 is a cross-sectional view taken along a line D-D shown in FIG. 16.

As depicted in FIG. 19 and FIG. 20, a portion in which the retainer member 70*a* is arranged is a portion easy to secure a space for fixation in both exhaust and intake sides. Thus, one side of the retainer member 70*a* is formed with fixation seat surface 77*a*, placement surface 77*b* and passage 77*c*.

The fixation seat surface 77*a* is formed above the fitting portion 73. The placement surface 77*b* is formed below the fitting portion 73. The placement surface 77*b* is flush with the lower surface of the main body 72. The passage 77*c* extends from the fixation seat surface 77*a* to the placement surface 77*b* through the rocker shaft 12.

Another side of the retainer member 70*a* is formed with boss 79, fixation seat surface 79*a*, placement surface 79*b* and passage 79*c*. The boss 79 is bulged from the lower portion of the fitting portion 74 toward the axial direction. The fixation seat surface 79*a* is formed above the boss 79. The placement surface 79*b* is formed below the boss 79. The placement surface 79*b* is flush with the lower surface of the main body 72. The passage 79*c* is formed in the boss 79. The passage 79*c* penetrates through the boss 79. The passage 79*c* communicates with the foregoing fixation seat surface 79*a* and placement surface 79*b*.

The retainer member 70*b* has a main body 84. The main body 84 has fitting portions 81, 82, and receiver portion 83. The intake rocker shaft 11 is slidably fitting into the fitting portion 81. The fitting portion 81 has a cylinder. The exhaust rocker shaft 12 is slidably fitting into the fitting portion 82. The fitting portion 82 has a cylinder. The receiver portion 83 has a wall shape. The receiver portion 83 supports the lower side of the support shaft 13. The foregoing fitting portions 81, 82 and receiver portion 83 are integrally formed.

As illustrated in FIG. 16, the foregoing portions of the main body 84, that is, fitting portions 81, 82 and receiver portion 83 are provided at the following place. Specifically, the fitting portion 81 is provided at the rocker shaft portion between the paired rocker arm mechanisms 19 in the rocker shaft 11. The fitting portion 82 is provided at the rocker shaft portion between the paired rocker arms 18 in the rocker shaft 12. The receiver portion 83 is provided at the support shaft 13 between bosses 46 of the swing cam 45.

The support shaft above the receiver portion 83 is fixed to the receiver portion 83 via a clamp tool. The clamp tool penetrates through the support shaft 13 from top, and is screwed into the receiver portion 83. The clamp tool is a bolt 86, for example.

The foregoing structure is given, and thereby, the intermediate portions of the shafts 11 to 13 are held by the retainer member 70*b* in a state of mutually keeping a predetermined space.

As described above, the intermediate portions of the shafts 11 to 13 are held by the retainer member 70*b* while end portions of them are held by the retainer member 70*a*. By doing so, components of the valve system 8 including the rocker arm mechanism 19 and the variable valve unit 20 is assembled into one structure body U, that is, a modular unit.

The retainer member 70*b* is arranged at the intermediate position in the longitudinal direction of the cylinder head 1. Thus, the following structure is employed as the fixation structure of the retainer member 70*b*. Incidentally, in arranging the retainer member 70*b* in the cylinder head 1, a space for fixing any one of intake and exhaust sides is hard to be secured resulting from an influence by cylinders and water jacket. In the cylinder head 1 of the fourth embodiment, the space for fixation is hard to be secured in the vicinity of the intake rocker shaft 11.

Figure 18:
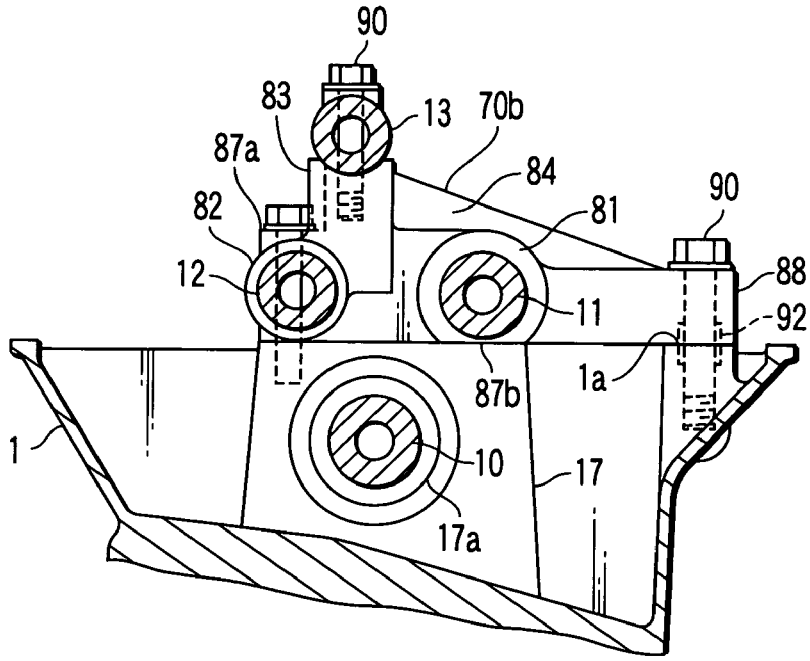
FIG. 18 is a cross-sectional view taken along a line C-C shown in FIG. 16.

As seen from FIG. 18 and FIG. 20, the retainer member 70*b* is formed with fixation seat surface 87*a*, placement surface 87*b* and passage 87*c* as the structure of fixing the exhaust side of the retainer member 70*b*.

The fixation seat surface 87*a* is formed above the fitting portion 82. The placement surface 87*b* is formed below the fitting portions 81 and 82. The passage 87*c* extends from the fixation seat surface 87*a* to the placement surface 87*b* via the rocker shaft 12.

The intake side of the retainer member 70*b* is fixed near the side edge of the cylinder head 1, and not near the rocker shaft 11 where a fixation space is not secured. Thus, a seat surface 1*a* is formed near the side edge of the cylinder head 1. The intake side of the retainer member 70*b* is fixed to the seat surface 1*a*. The vicinity of the side edge of the cylinder head 1 is a place, which avoids the rocker shaft 11 in the cylinder head 1.

The foregoing point will be explained below. The side of the fitting portion 81 is formed with a projected portion 88. The projected portion 88 extends toward the seat surface 1*a*. The end portion of the projected portion 88 is formed with a through hole 89 vertically extending.

Figure 21:
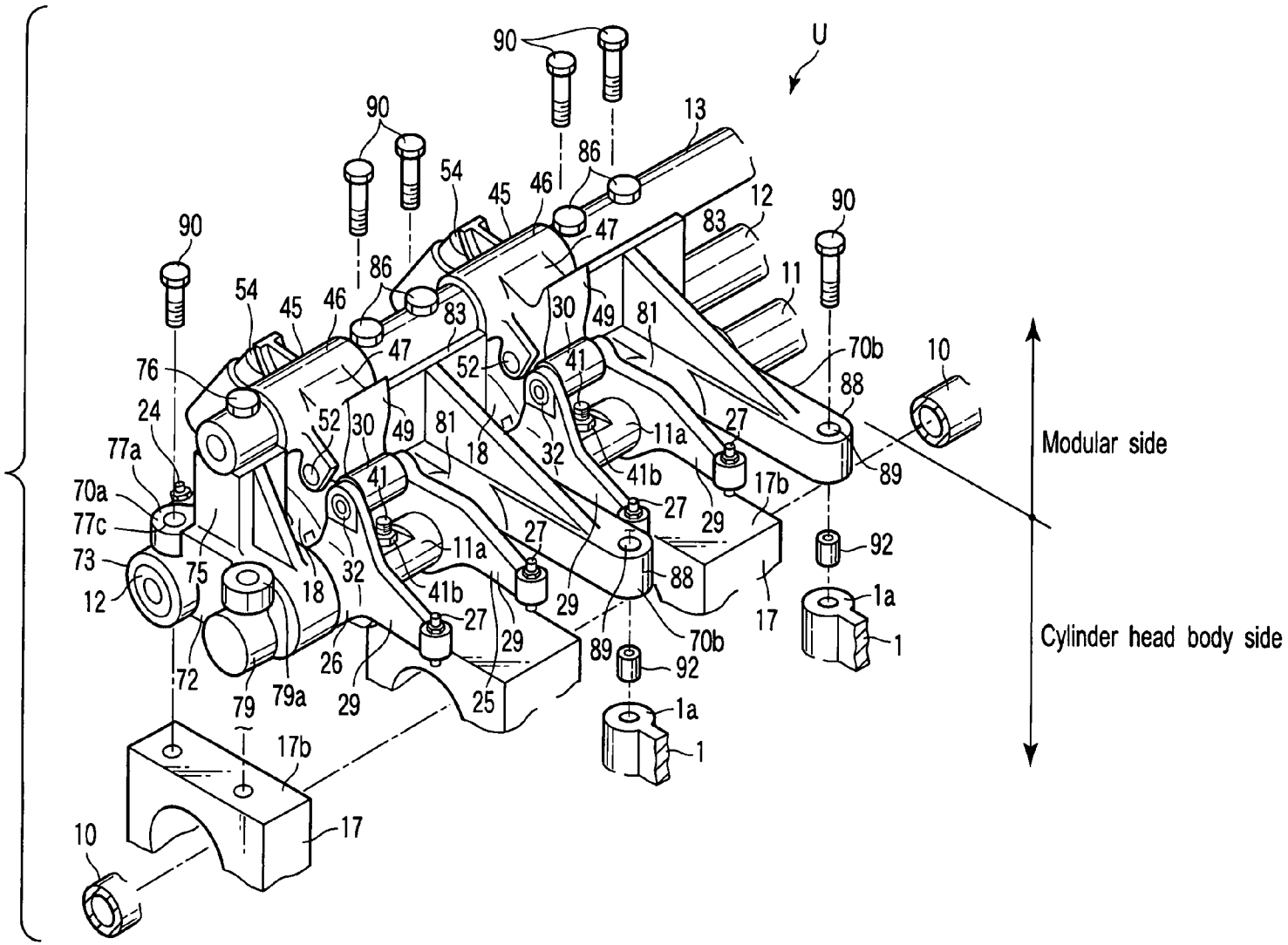
FIG. 21 is an exploded perspective view showing a modularized value unit.

As shown in FIG. 21, by the foregoing structure, a structure unit U is fixed to the upper surface of the cylinder head 1. Specifically, as seen from FIG. 19, the retainer member 70*a* is placed on a set surface 17*b* formed on the upper surface of the support base 17 arranged on both sides in the longitudinal direction of the cylinder head 1.

As illustrated in FIG. 18, the each retainer member 70*b* is placed on the seat surface 1*a* and a set surface 17*b* formed on the upper portion of the support base 17 arranged at the intermediate position in the longitudinal direction of the cylinder head 1.

As depicted in FIG. 20 and FIG. 21, the retainer members 70*a* and 70*b* are placed just like foregoing, and thereafter, bolts 90 are inserted into the support base 17 via the seat surfaces 77*a* and 79*a* of the retainer member 70*a*. These bolts 90 are screwed into the support base 17.

Likewise, bolts 90 are inserted into the support base 17 via the fixation seat surfaces 87*a* of the retainer member 70*b*. These bolts 90 are screwed into the support base 17. Further, the bolt 90 is inserted into the cylinder head 1 from the through hole 89 via the seat surface 1*a*. The bolt 90 is screwed into the cylinder head 1.

The foregoing fixation structure is given, and thereby, the structure unit U is fixed to the cylinder head 1 avoiding the vicinity of the intake rocker shaft 11.

As seen from FIG. 18 and FIG. 20, a positioning knock pin 92 is formed on the upper portion of the seat surface 1*a* corresponding to the through hole 89. The knock pin 92 is used to position the structure unit U with respect to the cylinder head 1.

The projected portion 88 of each retainer member 70*a*, 70*b* is fixed after the structure unit U is positioned to the cylinder head 1 using the knock pin 92.

According to the fourth embodiment, components of the rocker arm mechanism 19, intake and exhaust rocker shafts 11, 12 and support shaft 13 are assembled into a modular unit using the retainer members 70*a* and 70*b*.

The foregoing modular unit is fixed to the cylinder head 1. Thus, as shown in FIG. 21, the actuation timing of each intake valve 5 is made before the structure unit U is assembled into the cylinder head 1. Therefore, since no load is applied to the rocker arm mechanisms 18 and 19 from the intake valve 5 and the exhaust valve 6, adjustment is readily made.

The projected portion 88 contacts with the cylinder head 1, and thereby, the retainer member 70*b* is fixed to the cylinder head 1 over a wide range. Therefore, stability of the structure body U is improved.

The projected portion 88 of the retainer member 70*b* is projects toward the opposite side of the exhaust rocker shaft 12 with respect to the intake shaft 11. The projected portion 88 is fixed to the cylinder head 1 using the bolt member 90.

Thus, the structure is given such that the fulcrum of the center rocker arm 35 is displaced with the rotation and displacement of the rocker shaft 11. In this case, the change of posture of the retainer member 70*b* around the bolt 90 fixing the projected portion 88 is smaller on the side of the fitting portion 81 rather than the fitting portion 81.

In other words, the displacement of the fitting portion 81 is made smaller. Therefore, a clearance required for smoothly driving the rocker shaft 11 is readily secured between the rocker shaft 11 and the retainer member 70*b*.

Moreover, the knock pin 92 is provided at the place where the bolt 90 is provided, and thereby, the displacement of the retainer member 70*b* is prevented. As a result, the displacement of the intake rocker shaft 11 is further prevented.

The present invention is not limited to the foregoing embodiments. Various changes may be made within the scope without diverging from the subject matter of the invention. For example, in the foregoing embodiments, the structure in which the pin member is inserted into the rocker shaft and the swing cam is employed as the adjustment mechanism. According to the adjustment mechanism, the short shaft is replaced. However, the adjustment mechanism is not limited to the foregoing structures; in this case, other structure may be used.

According to the foregoing embodiments, the present invention is applied to an engine including SOHC type valve system for driving intake and exhaust valves using one camshaft. However, the present invention is not limited to the engine including SOHC type valve system. The present invention is applicable to an engine including DOHC type valve system having a structure in which a camshaft is provided on both intake and exhaust sides.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve unit for an internal combustion engine, comprising:

a camshaft rotatably provided in an internal combustion engine, the internal combustion engine including an intake valve and an exhaust valve;

a power transmission member opening and closing at least one of the intake valve and the exhaust valve, and driven by the camshaft; and an adjustment mechanism that allows adjustment of a drive position of the camshaft with respect to the power transmission member during a non-operating condition of the internal combustion engine.

2. The variable valve unit for an internal combustion engine according to claim 1, wherein the adjustment mechanism is provided at a place not affected by a rotation of the camshaft.

3. The variable valve unit for an internal combustion engine according to claim 2, further comprising:

a rocker shaft rotatably provided in the internal combustion engine, wherein the power transmission member includes a first arm opening and closing the intake valve or the exhaust valve, and swingably supported to the rocker shaft, and wherein, the adjustment mechanism allows adjusting of a drive position of the camshaft with respect to the first arm.

4. The variable valve unit for an internal combustion engine according to claim 3, wherein the adjustment mechanism is attached to the rocker shaft.

5. A variable valve unit for an internal combustion engine according to claim 4, further comprising:

a support shaft arranged in the vicinity of the rocker shaft, wherein the power transmission member includes:

a second arm driven by a cam formed in the camshaft, and swingably with the rocker shaft side as the fulcrum; and a third arm swingably attached to the support shaft, and receiving a displacement of the second arm, and varying a phase of the cam in accordance with a position change of the second arm generated by movement of the fulcrum of the second arm to drive the first arm; and wherein, the adjustment mechanism allows adjusting of a drive position of the third arm with respect to the first arm in a non-actuation of the internal combustion engine.

6. A variable valve unit for an internal combustion engine according to claim 5, further comprising:

a relay member supported by the rocker shaft, and having a tip end portion projected from the rocker shaft to be rotatably supported by the second arm, the position of the relay member being displaced with a rotation of the rocker shaft, the fulcrum of the second arm being displaced by the displacement.

7. The variable valve unit for an internal combustion engine according to claim 6, wherein the adjustment mechanism allows adjusting of a projection of a quantity of the tip end of the relay member projected from the rocker shaft.

8. A variable valve unit for an internal combustion engine according to claim 3, further comprising:

a support shaft arranged in the vicinity of the rocker shaft, wherein the power transmission member includes:

a second arm swingable with the rocker shaft side as the fulcrum, and abutting against a cam formed in the camshaft, and driven via the cam; and a third arm swingably attached to the support shaft, receiving a displacement of the second arm, and varying a phase of the cam in accordance with a position change of the second arm generated by movement of the fulcrum to drive the first arm, and wherein, the adjustment mechanism allows adjusting of a drive position of the third arm with respect to the first arm in a non-actuation of the internal combustion engine.

9. The variable valve unit for an internal combustion engine according to claim 8, further comprising:

a support shaft arranged in the vicinity of the rocker shaft, wherein the power transmission member includes:

a second arm driven by a cam formed in the camshaft, and swingably with the rocker shaft side as the fulcrum; and a third arm swingably attached to the support shaft, and receiving a displacement of the second arm, and varying a phase of the cam in accordance with a position change of the second arm generated by movement of the fulcrum of the second arm to drive the first arm; and wherein, the adjustment mechanism allows adjusting of a drive position of the third arm with respect to the first arm in a non-actuation of the internal combustion engine.

10. The variable valve unit for an internal combustion engine according to claim 9, further comprising:

a relay member supported by rocker shaft, and having a tip end projected from the rocker shaft to be rotatably supported by the second arm, the position of the relay member being displaced with a rotation of the rocker shaft to displace the fulcrum of the second arm being displaced by the displacement.

11. The variable valve unit for an internal combustion engine according to claim 10, wherein the adjustment mechanism allows adjusting of a projection of the tip end of the relay member projected from the rocker shaft.

12. The variable valve unit for an internal combustion engine according to claim 2, wherein the adjustment mechanism allows manual adjustment of the drive position of the camshaft with respect to the power transmission member during a non-operating condition of the internal combustion engine for servicing of the internal combustion engine.

13. The variable valve unit for an internal combustion engine according to claim 2, wherein the adjustment mechanism includes a screw structure.

14. The variable valve unit for an internal combustion engine according to claim 2, wherein the power transmission member, whose position is adjusted by the adjustment mechanism, is a swingable member having a cam face.

15. A variable valve unit for an internal combustion engine, comprising:

a rocker shaft rotatably provided in an internal combustion engine, the internal combustion engine including an intake valve and an exhaust valve;

a camshaft rotatably provided in the internal combustion engine, and formed with a cam;

a first arm swingably supported by the rocker shaft to drive any one of the intake valve and the exhaust valve;

a second arm driven by the cam, and swingable with the rocker shaft side as the fulcrum;

a support shaft arranged in the vicinity of the rocker shaft, a third arm swingably attached to the support shaft, receiving a displacement of the second arm, and varying a phase of the cam in accordance with a position change of the second arm generated by movement of the fulcrum of the second arm to drive the first arm, an adjustment mechanism that allows adjusting of a drive position of the third arm with respect to the first arm in a non-actuation of the internal combustion engine, and attached to the third arm.

16. A variable valve unit for an internal combustion engine according to claim 15, further comprising:

a retainer member modularizing the rocker shaft, the support shaft, the first arm, the second arm, the third arm, and the adjustment mechanism.

17. A variable valve unit for an internal combustion engine according to claim 16, wherein the retainer member has a projected portion, which extends from the rocker shaft to a side edge of the cylinder head, an end portion of the projected portion is fixed to the cylinder head, and in the retainer member, a place far from the end portion of the projected portion is fixed to the cylinder head.

18. The variable valve unit for an internal combustion engine according to claim 17, wherein the projected portion is fixed after the opposite side of the retainer member is positioned to the cylinder head.

19. The variable valve unit for an internal combustion engine according to claim 1, wherein the adjustment mechanism allows manual adjustment of the drive position of the camshaft with respect to the power transmission member during a non-operating condition of the internal combustion engine for servicing of the internal combustion engine.

20. A variable valve unit for an internal combustion engine, comprising:

a camshaft rotatably provided in the internal combustion engine, and formed with a cam, the internal combustion engine including an intake valve and an exhaust valve;

a rocker shaft rotatably provided in the internal combustion engine;

a support shaft arranged in the vicinity of the rocker shaft; and a power transmission member opening and closing any one of the intake valve and the exhaust valve, and varying a drive range of the power transmission member, thereby varying a valve lift of any one of the intake valve and the exhaust valve, the power transmission member including:

a first arm driving any one of the intake valve and the exhaust valve, and swingably supported by the rocker shaft;

a second arm driven by the cam and swingable with the rocker shaft side as the fulcrum, and further, having a drive plane;

a third arm swingably attached to the support shaft, and receiving a displacement of the second arm, and varying a phase of the cam in accordance with a position change of the second arm generated by movement of the fulcrum of the second arm to drive the first arm; and a shaft member attached to the third arm, and rotatably supported in a swingable direction of the third arm, and having a driven surface contacting with the drive plane, the driven surface formed at an outer peripheral portion of the shaft member, the shaft member being replaced with another shaft member having a driven surface different from the driven surface, thereby changing a relative position of the third arm with respect to the second arm to adjust a drive position of the third arm with respect to the first arm.

* * * * *